United States Patent [19]

Delsol

[11] Patent Number: 4,961,402

[45] Date of Patent: Oct. 9, 1990

[54] DEVICE FOR SUSPENDING A HORIZONTAL HEAT EXCHANGE TUBE ON A VERTICAL SUPPORT TUBE

[75] Inventor: Gilbert Delsol, Cernay la Ville, France

[73] Assignee: Societe Anonyme dite: STEIN INDUSTRIE, Velizy-Villacoublay, France

[21] Appl. No.: 457,671

[22] Filed: Dec. 27, 1989

[51] Int. Cl.[5] ..... F22B 37/24; F28F 9/04

[52] U.S. Cl. ..... 122/510; 122/512; 165/178

[58] Field of Search ..... 122/510, 512; 165/178

[56] References Cited

U.S. PATENT DOCUMENTS

| | | | |
|---|---|---|---|
| 3,164,137 | 1/1965 | Liessenberg | 122/510 |
| 3,168,076 | 2/1965 | Olsen et al. | 122/510 |
| 3,265,044 | 8/1966 | Tuchtern | 122/510 |
| 4,100,889 | 7/1978 | Chayes | 122/510 |
| 4,753,197 | 6/1988 | Mullinax | 165/178 |
| 4,848,452 | 7/1989 | McDonald et al. | 165/178 |

FOREIGN PATENT DOCUMENTS 0037243 10/1981 European Pat. Off. .

*Primary Examiner*—Henry C. Yuen

*Attorney, Agent, or Firm*—Sughrue, Mion, Zinn, Macpeak & Seas

[57] ABSTRACT

A device for suspending a horizontal heat exchange tube on a vertical support tube is provided comprising:

(a) an element for securing the horizontal tube, in the general form of a cradle, consisting of two symmetrical cylindrical cross-bars and two connecting members for the cross-bars in an arc of a circle;

(b) two elements for securing the vertical tube, each comprising a plane portion provided on their side facing the vertical tube with two lateral edges and an oblique portion forming a folded-over part; these elements interlocking by engagement of their recesses with the wedge-shaped parts of the cross-bars of the securing element for the horizontal tube, and being welded to the vertical tube along the lateral edges of their plane portion.

6 Claims, 2 Drawing Sheets

DEVICE FOR SUSPENDING A HORIZONTAL HEAT EXCHANGE TUBE ON A VERTICAL SUPPORT TUBE

The present invention concerns a device for suspending a horizontal heat exchange tube on a vertical support tube.

The applicant has already proposed in his French patent application No. 2 555 722 a device for suspending a bundle of horizontal tubes along the same vertical plane, comprising pairs of vertical tubes provided on their opposite sides with half-flange or -finned sections including circular grooves, having a radius slightly larger than that of the tubes of the bundle, and separated by a distance equal to that of the tubes; separated by tongues wide enough to ensure correct support of the tubes of the bundle, but sufficiently narrow to ensure good heat conduction from their edge to their region of welding to the corresponding vertical tube. In such a device, the horizontal tubes are not connected to the vertical support tubes by any welding and have a certain freedom of movement with respect to the flanges. When such a device is installed in an enclosure or is subjected to vibrations, the horizontal tubes can suffer long-term damage by shocks with the flanges. This leads to wear and finally perforation of the tubes, especially when they are sunk into an abrasive medium, comprising for example cinders or a fluidized bed.

The applicant has also proposed in French patent application Ser. No. 7715558 dated Nov. 10, 1987 a device for suspending in a vertical plane a panel of horizontal tubes in a hairpin arrangement, by means of vertical tubes suspended to a rigid structure crossed through by a fluid cooler than that in which the panel is sunk, disposed along a vertical plane close to that of the panel and rendered integral with the horizontal sections of the tubes disposed in a hair-pin arrangement by connecting pieces welded at one end on a section of horizontal tube, and at the other end on a vertical tube, along the generating lines of these tubes. However, since the connection between the horizontal tubes and the vertical tubes is rigid, the differential expansions and the vibrations to which the tubes can be subjected creates long-term risks of rupturing the welding lines and thereby provoking deterioration and possible perforation of the tubes.

The object of the present invention is to provide a device for suspending a horizontal heat exchange tube (or possibly two horizontal tubes) on a vertical support tube, that does not resist rigidly to relative differential expansions or vibrations between the horizontal heat exchanger and the vertical support tubes, and thus prevents the possibility of rupturing the welds under the effect of these differential expansions or vibrations.

The suspension device according to the invention is characterized in that it comprises:

(a) an element for securing the horizontal tube, in the general form of a cradle, comprising:
  (i) two symmetrical cylindrical cross-bars having an inner surface of radius of curvature slightly greater than that of the horizontal tube, and generating lines parallel to the axis of this tube, separated by an empty space, these cross-bars having on the side opposite said empty space an acute-angled wedge-shaped part; and
  (ii) two connecting members for the cross-bars in an arc of a circle, each including a circular edge having a radius of curvature equal to that of the horizontal tube, in a plane perpendicular to the axis thereof, and tapering outwards on their outer side with respect to the empty spare; said securing element being welded to the horizontal tube along the circular edges of the members;

(b) two elements for securing the vertical tube, each comprising a plane portion provided on their side facing the vertical tube with two lateral edges parallel to the axis of this tube, and an oblique portion forming a folded-over part defining with the surface of the plane part opposite the vertical tube an acute-angled recess corresponding to that of the wedge-shaped part of the cross-bars, these elements, of width smaller than that of the cross-bars of the elements securing the horizontal tube, interlocking by engagement of their recesses with the wedge-shaped parts of the cross-bars of the securing element for the horizontal tube, and being welded to the vertical tube along the lateral edges of their plane portion.

It furthermore preferably satisfies at least one of the following characteristics:

the acute-angled wedge-shaped parts of the cross-bars have a hollowed-out area at their central portion, and in the middle of the recesses separating the plane portion from the oblique portion forming a folded-over part of the element securing the vertical tube, walls or partitions for strengthening said element securing the vertical tube are disposed, said walls having a width smaller than that of the corresponding hollowed-out area, the strengthening walls of the elements securing the vertical tube are provided with a median slot, the acute angle of the wedge-shaped parts of the cylindrical surfaces of the element securing the horizontal tube is comprised between 30° and 45°, the tapered portions of said cross-bar connecting members have, on the side opposite their plane of symmetry, a frustro-conical surface.

The following is a description, given by way of example and with reference to the appended drawing, of a device for suspending two horizontal tubes from a heat exchange panel on a vertical support tube connected to a fixed structure.

Figure 1:
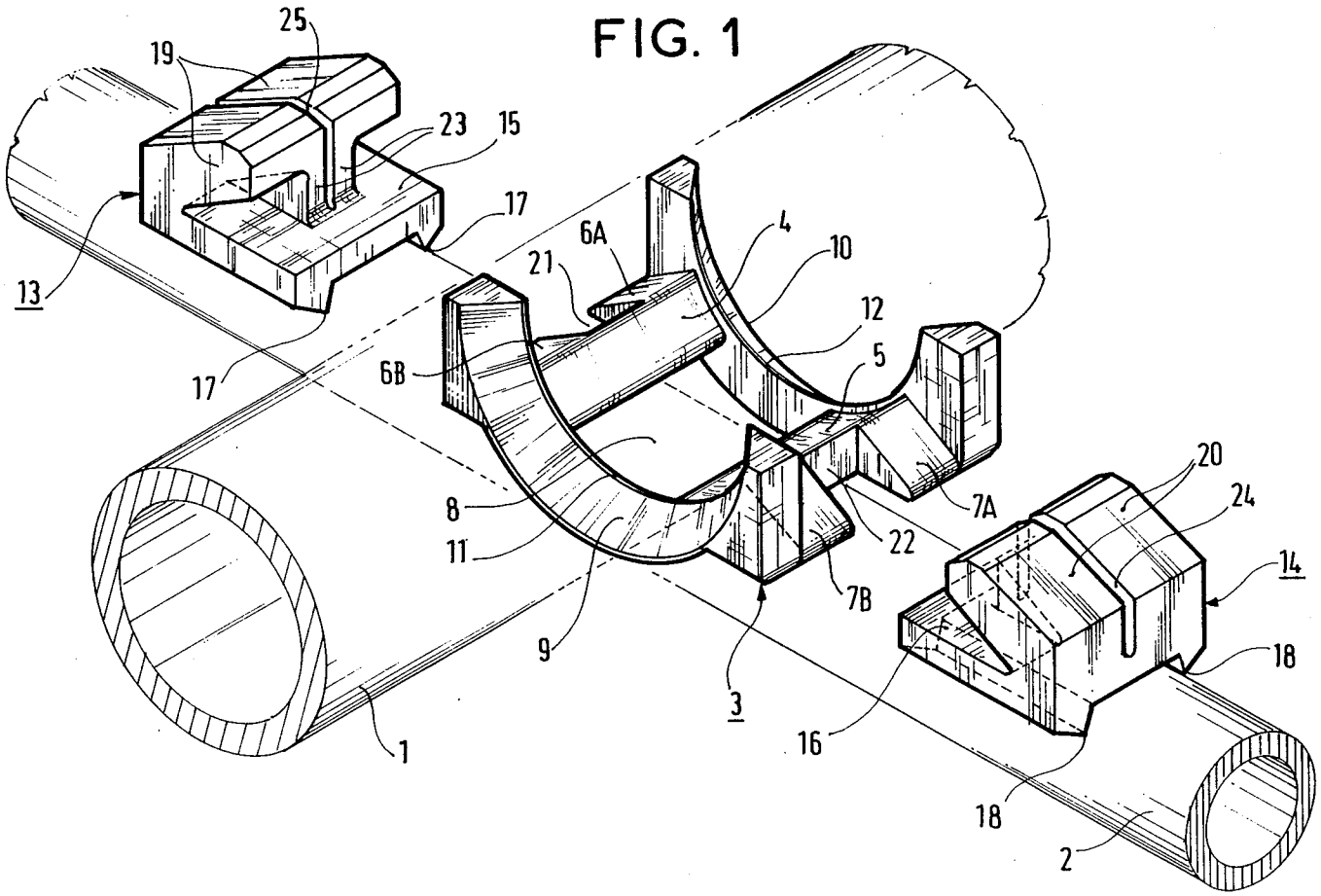
FIG. 1 is a perspective view of the intermediate parts used for securing horizontal tube onto the vertical support tube.

In FIG. 1, the horizontal tube 1 and the vertical tube 2 have been represented obliquely for case of understanding. They are associated by means of the securing element of the horizontal tube, generally represented by reference 3, and securing elements for the vertical tube, generally represented by references 13 and 14.

The securing element for the horizontal tube forms a cradle for this latter. It comprises symmetrical cross-bars 4, 5, provided on the inner side of the cylindrical surfaces, with a radius of curvature slightly greater than that of the horizontal tube, and which hence mate up with its circumference, on either side of the empty spare or region 8. The side opposite to this spare is formed of acute-angled wedge-shaped parts 6A, 6B, 7A, 7B, of for example between 35° and 40°, on either side of a central hollow or recess 21, 22. These wedge-shaped parts and this hollowed-out area are intended to ensure the interlocking of element 3 with the elements securing the vertical tube, such as will be described hereinafter.

The cross-bars 4, 5 are connected to each other by members 9, 10 having the general form of an arc of a circle. They comprise on the inner side a circular edge 11, 12 having a radius equal to that of the horizontal tube, and tapered off on the outer side in a frustro-conical surface.

The elements 13, 14 securing the vertical tube each comprise a plane portion 15, 16 provided on the side nearest this tube, on either side of a central sole, with lateral edges such as 17, 18 parallel to the axis of the tube. These plane portions are continued by oblique folded-over portions 19, 20 delimiting with the upper surface of the plane portions recesses having the form of an acute angle equal to the acute angle of the wedge-shaped parts of the element securing the horizontal tube. The width of these securing elements 13, 14 is slightly smaller than that of the cross-bars 4, 5 of the element securing the horizontal tube.

Between the lateral recesses, central walls such as 23 having a width slightly smaller than that of the hollowed-out areas 21, 22 of the cross-bars of the elements securing the horizontal tube, are provided in order to match up with these hollowed-out areas and allow the interlocking of the pieces 13 14 with the piece 3. They are provided at their middle with slots 24, 25 nevertheless conferring a certain flexibility on the pieces 13, 14 perpendicularly to their plane.

It can be seen that if the pieces 13, 14 are made to slide along the tube 2, they become interlocked on the cross-bars 4, 5 of the piece 3, the wedge-shaped parts 6A, 6B and 7A, 7B of this latter fitting into their recesses, and the central walls such as 23 fitting into the hollowed-out areas such as 21 of piece 3.

Figure 2:
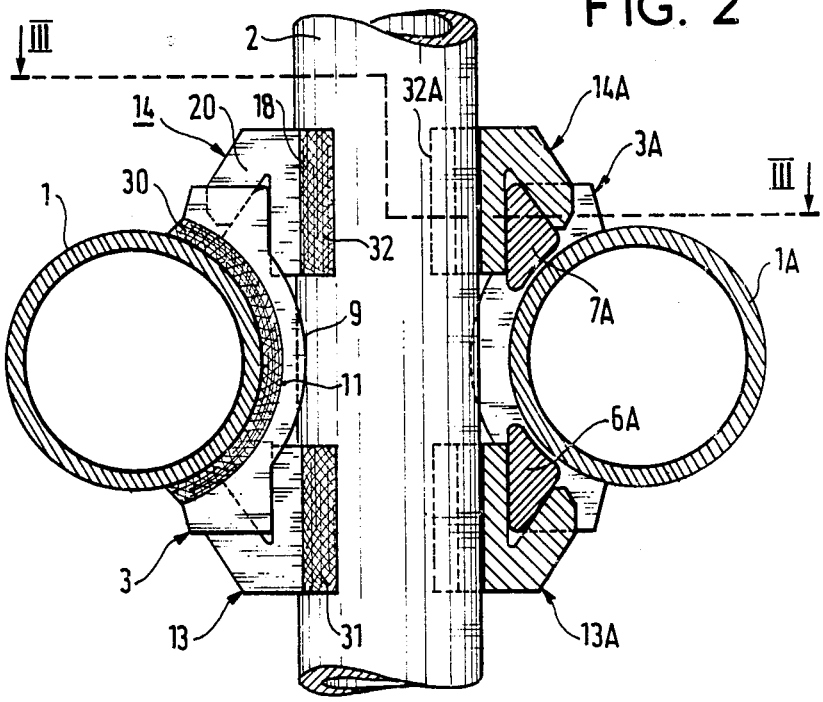
FIG. 2 shows, in a section according to axis II—II of FIG. 3, the connection between this latter and two horizontal tubes at each of its sides.
Figure 3:
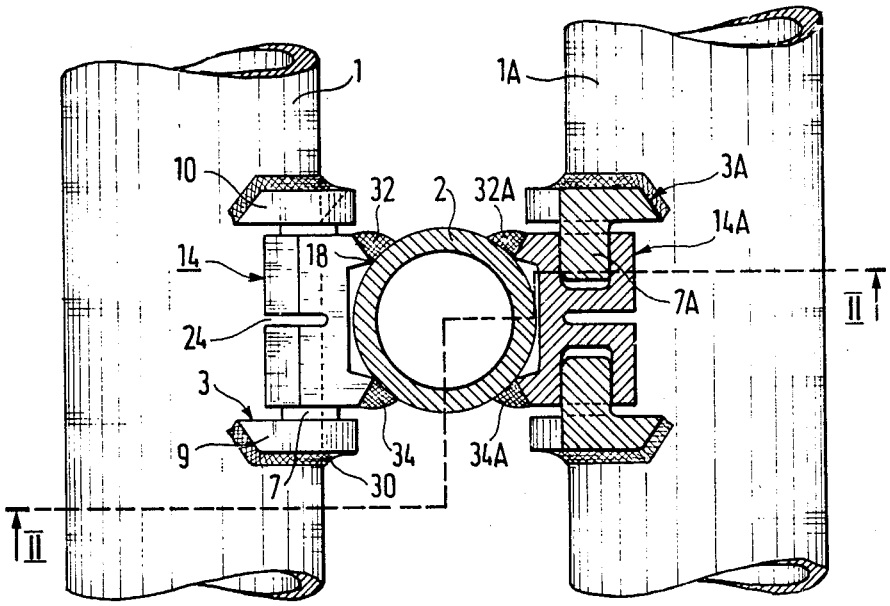
FIG. 3 shows the same connection in section according to axis III—III of FIG. 2.

FIGS. 2 and 3 show how the different pieces are welded on the tubes and ensure their joining in a flexible manner, while allowing differential expansions between them. Piece 3 is welded onto the horizontal tube 1 along its circular edges 11, 12 by two welding seams such as 30, the only one that is visible. Another horizontal tube 1A is welded onto another piece 3A at the other side of the vertical tube 2. The pieces 13, 13A and 14, 14A are welded onto the vertical tube along their edges such as 17, 18 by welding seams such as 31, 32 represented on FIG. 2, and 32, 32A, 34, 34A represented on figure 3. The wedge-shaped parts 6A, 7A of the piece 3A ensure blocking of pieces 13A, 14A.

What is claimed is:

1. Device for suspending a horizontal heat exchange tube on a vertical support tube, wherein it comprises:

(a) an element for securing the horizontal tube, in the general form of a cradle, comprising:

(i) two symmetrical cylindrical cross-bars having an inner surface of radius of curvature slightly greater than that of the horizontal tube, and generating lines parallel to the axis of this tube, separated by an empty space, these cross-bars having on the side opposite said empty space an acute-angled wedge-shaped part; and (ii) two connecting members for the cross-bars in an arc of a circle, each including a circular edge having a radius of curvature equal to that of the horizontal tube, in a plane perpendicular to the axis thereof, and tapering outwards on their outer side with respect to the empty spare;

said securing element being welded to the horizontal tube along the circular edges of the members;

(b) two elements for securing the vertical tube, each comprising a plane portion provided on their side facing the vertical tube with two lateral edges parallel to the axis of this tube, and an oblique portion forming a folded-over part defining with the surface of the plane part opposite the vertical tube an acute-angled recess corresponding to that of the wedge-shaped part of the cross-bars, these elements, of width smaller than that of the cross-bars of the elements securing the horizontal tube, interlocking by engagement of their recesses with the wedge-shaped parts of the cross-bars of the securing element for the horizontal tube, and being welded to the vertical tube along the lateral edges of their plane portion.

2. Device according to claim 1, wherein the acute-angled wedge-shaped parts of the cross-bars have a hollowed-out area at their central portion, and in the middle of the recesses separating the plane portion from the oblique portion forming a folded-over part of the element securing the vertical tube, walls or partitions for strengthening said element securing the vertical tube are disposed, said walls having a width smaller than that of the corresponding hollowed-out area.

3. Device according to claim 2, wherein the strengthening walls of the elements securing the vertical tube are provided with a median slot.

4. Device according to claim 2, wherein the acute angle of the wedge-shaped parts of the cylindrical surfaces of the element securing the horizontal tube is comprised between 30° and 45°.

5. Device according to claim 1, wherein the acute angle of the wedge-shaped parts of the cylindrical surfaces of the element securing the horizontal tube is comprised between 30° and 45°.

6. Device according to claim 1, wherein the tapered portions of said cross-bar connecting members have, on the side opposite their plane of symmetry, a frustro-conical surface.

* * * * *